US005472209A

United States Patent [19]

Goldfarb

[11] Patent Number: 5,472,209

[45] **Date of Patent: * Dec. 5, 1995**

[54] METHOD OF PLAYING A GAME OF CHANCE WITH A UNIVERSAL BINGO CARD AT THE GAME SITE OR LOCATIONS REMOTE FROM THE GAME SITE

[76] Inventor: Simon Goldfarb, 525 S. Ardmore, Los Angeles, Calif. 90020

[ * ] Notice: The portion of the term of this patent subsequent to Aug. 2, 2011, has been disclaimed.

[21] Appl. No.: 169,510

[22] Filed: Jan. 26, 1994

[51] Int. Cl.[6] ..... A63F 3/06

[52] U.S. Cl. ..... 273/269; 273/139; 273/439

[58] Field of Search ..... 273/269, 139, 273/148 R, 439

[56] References Cited

U.S. PATENT DOCUMENTS 4,019,744 4/1977 Pizur, Sr. ..... 273/269

FOREIGN PATENT DOCUMENTS 3820851 12/1989 Germany ..... 273/148 R

*Primary Examiner*—Benjamin H. Layno
*Attorney, Agent, or Firm*—Erik M. Arnhem

[57] ABSTRACT

Persons can participate in a game of chance, such as BINGO, played at the game site or remotely away from the site where the winning numbers are drawn. Each player can mark his predicted winning number combination on a specially designed game sheet. The game sheet preferably has twenty four spaces arranged in vertical columns and horizontal rows, as in a conventional BINGO card. Each space has fifteen numerals printed therein, such that the game player can select a particular number by marking over one (and only one) of the numerals in each space. The invention gives the player a wider choice of numbers when playing the game of BINGO, either at the game site or remotely from some other location.

9 Claims, 2 Drawing Sheets

REMOTE BINGO GAME

10

TO BE FILLED OUT BY PLAYER (PLEASE PRINT)

Players Name

Players Address

Telephone Number

Fax Number

HOW WILL I PAY FOR THIS GAME:

- ☐ Telephone Bill.
- ☐ Credit Card ☐ Visa/MC no: ☐ Other
- ☐ Account Number:

HOW DO I WANT TO COLLECT MY WINNING:

- ☐ To be credited to my account
- ☐ By check to my address.
- ☐ Other. Explain

GAME CHOICES

| How many | How Many |
|---|---|
| (____) Vertical Lines | (____) Horizontal Lines |
| (____) Diagonal Lines | (____) Four Corners |
| (____) Full Card | (____) Other _____ |

TOTAL AMOUNT AUTHORIZED TO PLAY. $ _____

SIGNATURE _____

GAME OPERATOR CONFIRMATION

DATE RECEIVED: _____

HOUR RECEIVED: _____

RECEIVED ON FAX NO.: _____

DATE TO BE PLAYED: _____

APPROX. HOUR: _____

CONFIRMATION NO.: _____

GAME INSPECTOR NO.: _____

OFFICIAL STAMP:

GAME OPERATOR AUTH. SIGNATURE

AMOUNT CHARGED IN _____

$_____

INFORMATION

Player can play all vertical or horizontal lines he/she wants. Price: $2.00 Each Line • $2.50 Diagonal Line • $2.50 Four Corners • $10.00 Full Sheet.

Free Consultation (000) 000-000

Player will fill only one number in each space below • Do not repeat any number

| B | | | | | I | | | | | N | | | | | G | | | | | O | | | | |
|---|---|---|---|---|---|---|---|---|---|---|---|---|---|---|---|---|---|---|---|---|---|---|---|---|
| 1-15 | | | | | 16-30 | | | | | 31-45 | | | | | 46-60 | | | | | 61-75 | | | | |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |
| 1 | 2 | 3 | 4 | 5 | 16 | 17 | 18 | 19 | 20 | | | | | | 46 | 47 | 48 | 49 | 50 | 61 | 62 | 63 | 64 | 65 |
| 6 | 7 | 8 | 9 | 10 | 21 | 22 | 23 | 24 | 25 | | | | | | 51 | 52 | 53 | 54 | 55 | 66 | 67 | 68 | 69 | 70 |
| 11 | 12 | 13 | 14 | 15 | 26 | 27 | 28 | 29 | 30 | | | | | | 56 | 57 | 58 | 59 | 60 | 71 | 72 | 73 | 74 | 75 |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |
| 1 | 2 | 3 | 4 | 5 | 16 | 17 | 18 | 19 | 20 | 31 | 32 | 33 | 34 | 35 | 46 | 47 | 48 | 49 | 50 | 61 | 62 | 63 | 64 | 65 |
| 6 | 7 | 8 | 9 | 10 | 21 | 22 | 23 | 24 | 25 | 36 | 37 | 38 | 39 | 40 | 51 | 52 | 53 | 54 | 55 | 66 | 67 | 68 | 69 | 70 |
| 11 | 12 | 13 | 14 | 15 | 26 | 27 | 28 | 29 | 30 | 41 | 42 | 43 | 44 | 45 | 56 | 57 | 58 | 59 | 60 | 71 | 72 | 73 | 74 | 75 |

11

11

11

Game Operator _____ Fax No (____) _____

FIG. 1

METHOD OF PLAYING A GAME OF CHANCE WITH A UNIVERSAL BINGO CARD AT THE GAME SITE OR LOCATIONS REMOTE FROM THE GAME SITE

REFERENCE TO RELATED PATENT APPLICATION

This patent application contains some subject matter that is similar to subject matter contained in my co-pending patent application, Ser. No. 024,361, filed on Mar. 1, 1993 now U.S. Pat. No. 5,333,868. The present application discloses a novel game card that is not shown in application Ser. No. 024,361.

BACKGROUND AND SUMMARY OF THE INVENTION

Many persons enjoy playing games of chance, such as BINGO, or other similar games. However, in some cases a person may not be able to play the game because of transportation problems or for other reasons. Thus, the person may not be physically able to drive a car to the site of a BINGO game or to a store where lottery tickets are sold.

Many people playing the game of BINGO are dissatisfied with the fact that there is a limitation on the numbers and number combinations that can be played. Each BINGO card has specific numbers printed thereon, so that the person purchasing a particular BINGO card is required to play those particular numbers. The person does not have a choice as to the numbers that he or she can play.

The present invention concerns a method of playing a game such as BINGO, wherein the above-noted disadvantages are overcome. The method of this invention is designed to enable persons to play the game of BINGO without requiring the person to be physically present at the game site (where the BINGO numbers are drawn); the person can be located at the game site, or in some other location remote from the site.

The method of this invention further comprises the use of a BINGO card having provision for selecting different numbers, such that persons can select particular numbers and number combinations, without being restricted to particular numbers printed on the BINGO card.

The method of this invention further comprises the use of a computer for comparing the winning combinations with the winning predictions of the game players, whereby game winners can be very quickly ascertained and announced. The use of a computer speeds up the playing of the game in that there is no requirement for manually comparing winning numbers with numbers appearing on the card of the potential game winner, i.e. the person calling out,the word BINGO at the game site.

The method of the present invention involves the use of phone-operated facsimile machines for transmitting game information from each game player to the physical site where the game is being played, i.e. the place where the BINGO numbers are drawn, or the winning lottery numbers selected. Simultaneously, when dialing the telephone number to transmit the game information, the game player can automatically charge the cost therefor to his/her telephone bill, to a credit card or may apply an account directly with the game operating management. Each game player can insert a game sheet containing a predicted winning combination into a facsimile (fax) machine at his residence or where he might be at a particular point in time, e.g. in a hotel room or in a restaurant. Information on the game sheet is transmitted over the telephone line to a receiving fax machine located at the game site, e.g. the BINGO hall or the main lottery headquarters. An electronic reader device at the game site or a person will read the duplicate game sheet generated by the receiving fax machine, and electronically transmit the information on the sheet to a computer memory; at the same time the game operator can transmit a receipt confirmation to the game player with date and hour received, and further information as to approximate time of playing and number of the game, personal identification number, etc. The information received by the game operator is stored in the computer memory pending the time when the game is to be played or the winning lottery number drawn. At the designated time the winning numbers are punched into the computer and electronically compared with the numbers in the computer memory to select a game winner.

The game sheet used in playing the game of BINGO, or other similar game, is specially designed to permit each game player to select different numbers and number combinations; the game players are not restricted in the numbers they can play. A BINGO card embodying the invention has twenty five spaces arranged so that there are five vertical columns and five horizontal rows of spaces; each vertical column has a letter heading corresponding to one letter in the word BINGO, i.e. the letter B, the letter I, etc. Each of the twenty five spaces on the BINGO card has (with one exception) fifteen consecutive numbers printed therein. In the case of the first column (the "B" column), the numbers printed in each space are 1 through 15. The spaces in the remaining columns have different sets of numbers, e.g. 16 through 30, 31 through 45, 46 through 60, and 61 through 75. The BINGO card may be provided with a carbon card for record keeping purposes.

Game players have the option of selecting one number from the fifteen numbers appearing in each space on the BINGO card; the number-selection process can involve running a pencil over the selected number to form a black dot or square that is machine-readable. The BINGO card is thus tailored to the particular wishes of each game player prior to his or her participation in the BINGO game The player can play any desired combination of numbers, within the game rules (i.e. numbers falling between 1 and 75). The game operator will play less than 75 numbers. Principal advantages of the invention are that each game player can play the game without having to physically travel to the game site or to a lottery sales outlet. Moreover, each game player can automatically charge the amount played for to his/her telephone bill or to a credit card. or an open account directly with the game operating management.

A further advantage of the invention is that each player can select the numbers he or she wishes to play within the contraints of the BINGO game rules.

THE DRAWINGS

FIG. 1 is a plan view of a game sheet that can be used in playing the game of BINGO according to the present invention.

DESCRIPTION OF A PREFERRED EMBODIMENT OF THE INVENTION

Figure 3:
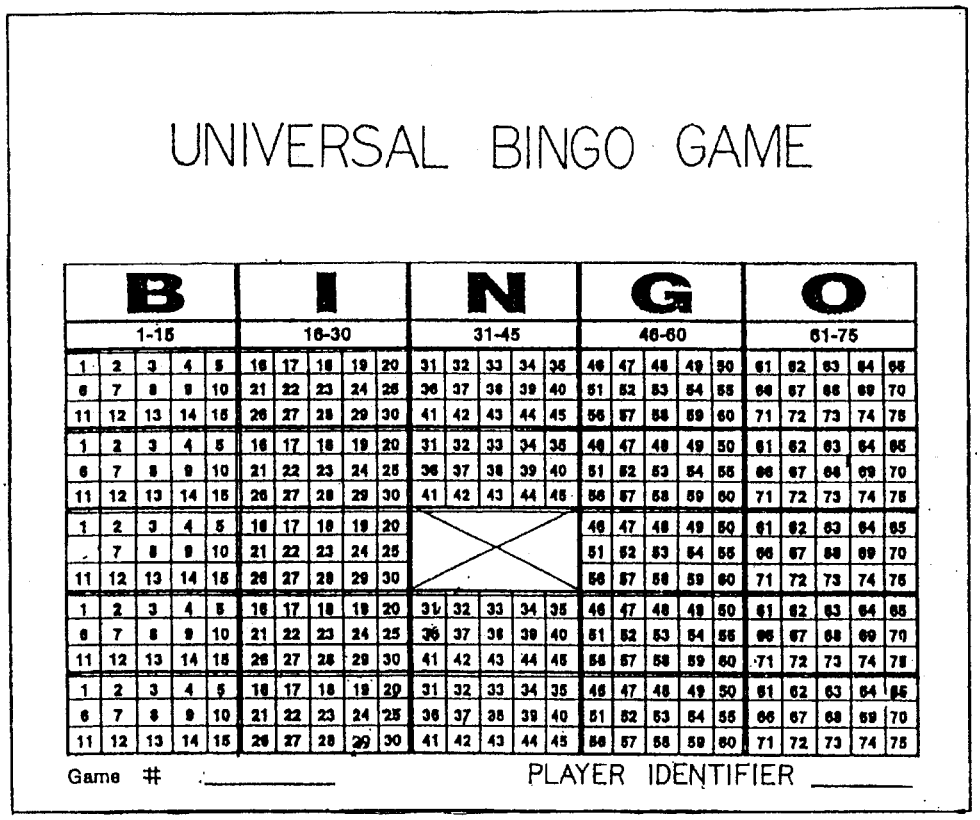
FIG. 3 is a plan view of another BINGO game sheet usable in practice of the present invention.

FIG. 1 shows a sheet or paper 10 having marked spaces thereon for placement of information by a person desiring to play the game of BINGO without physically travelling to the hall or similar location where the game is being conducted. Sheet 10 is designed for insertion into a conventional phone-operated facsimile machine (hereinafter fax machine) accessible to each person desiring to play the game remote from the game site. In order for the game player to automatically charge for the cost of the game participation, the game operator will e.g. provide a series of prefixed "900" telephone numbers (currently in use in the U.S. for charging the caller's cost to his/her telephone bill) each of which is assigned a dollar amount, e.g. $5.00, $10.00, etc., enabling the game player in transmitting the fax when calling one of the phone numbers, to indicate the specific dollar amount, chosen by him/her. The dollar amount, thus selected by the game player will automatically and simultaneously be recorded by the telephone operating system and charged to his/her telephone number; the amount charged is eventually forwarded by the telephone system to the game operator. As noted above, a detailed confirmation receipt will promptly be returned by the game operator only by fax to the game player; the receipt can be a copy of the game sheet signed by the game operator. The telephone system that is handling the automatic entry of the dollar amount to the game player's telephone bills or account could also be an integral part of the game operator's own business, or linked to a privately used telephone system. Depending on the magnitude of the geographical area involved, such fax machines (and game players) could be located at any locations within one city or state, or several states. Alternately the players could be in any room in a single hotel, or various rooms in a chain of hotels or restaurants.

Instead of charging the cost of the game to the player's telephone bill, the game costs could be charged to a credit card number, or to an account set up directly with the game operator. Game sheet 10 has specific areas for such information, and for the player's signature. The person's signature provides verification (or representation) that the person signing the game sheet is authorized to use the credit card number inserted on the game sheet.

The lower portion of game sheet 10 is marked off to provide twenty five spaces, similar to the spaces on a conventional BINGO card. The twenty five spaces are arranged in five vertical columns, with five spaces in each column. Collectively the spaces form five horizontal rows of spaces. In the drawing each space is identified by the numeral 11. As noted above, there are a total of twenty five spaces.

One letter of the word BINGO forms a heading or identifier for each column of five spaces. Thus, the letter "B" is used as a head for the first column of spaces, the letter "I" is used as a heading for the second column of spaces, and so on.

The central space 11 on the BINGO card is left blank. Each of the other spaces has fifteen numbers 1 through 15 thereon. Each space in the "1" column has numerals 16 through 30 printed therein. The numerals in the "N" column spaces go from 31 through 45; and the numerals in the "G" and "O" column spaces go, respectively, from 45 through 60, and from 61 through 75.

The game player will mark the card with his/her number selections prior to transmitting the game sheet to the game operator (via the fax phone process). If the player wishes to play all of the twenty four spaces he will run a pencil over one (and only one) of the numerals in each space 11. That marking will be the selected number for that space. The player has the option of playing only selected spaces, e.g. the four corner spaces. In that case he will mark only the numerals for the particular spaces he wishes to play.

The BINGO card shown in FIG. 1 is generally similar to a conventional BINGO card as regards its playability in a BINGO game, except that the FIG. 1 card permits the player to select a range of numbers and number combinations. With a conventional BINGO card the player is limited to a single specific number printed in each of the twenty four spaces.

The FIG. 1 game sheet can be filled out and used at any time prior to the time when the particular game(s) is (are) to be played, i.e. one or two hours prior to game time, or several days prior to the game date.

Figure 2:
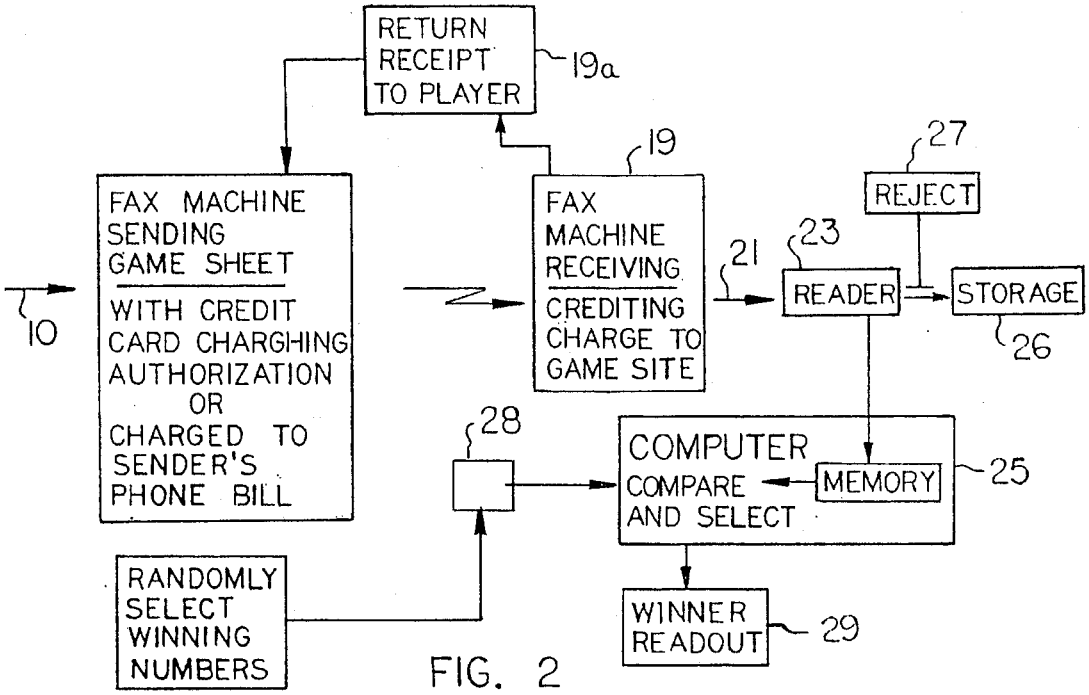
FIG. 2 is a flow diagram showing how information is transmitted, automatically paid for, and utilized during the playing of the game of BINGO, with the method of the present invention.

FIG. 2 shows generally how the game sheet of FIG. 1 is used during the playing e.g. of a BINGO game. The player inserts the completed game sheet 10 into a conventional fax machine 17, whereby the information on the sheet is transmitted over the phone line to another fax machine 19 located at the BINGO establishment (game site). The cost of the game participation may be charged simultaneously and automatically to the game person's telephone number, as explained in detail above. A facsimile (replica) sheet 21 is generated having the same information as sheet 10. A receipt **19*a*, confirming the date/hour received by the operator, including game session number, the amount chosen by the game player, etc. is promptly returned to the game player; the receipt is preferably a duplicate copy of the initial game sheet signed by the game operator employee to evidence initial receipt of the game sheet. Sheet 21 is passed through an electronic reader device 23, which reads and electronically collects the information contained in the respective spaces 11 on sheet 10**.

In some cases the game sheet 10 may have been filled out incorrectly, or without proper authorization, e.g. the account number may be overdrawn or otherwise not correct. A rejection mechanism 27 may be controlled by the reader device 23 to detour the affected sheet 21 away from storage 26. A human technician can examine the detoured sheet and phone the player to advise him or her of the situation.

During the playing of a game of BINGO, in which specially made balls with printed numbers are drawn out of a hopper, the drawn numbers may be numbers punched into a keyboard 28 operatively connected to the associated computer 25. In the computer the selected numbers are compared with the predicted numbers previously put into the computer memory by reader device 23. When, or if, the computer finds a match between the punched-in numbers and a particular set of numbers predicted by one or more players, the computer will generate a winner feed-out sheet 29 containing the winner's name.

Players of BINGO games usually want to know as quickly as possible when they have become a winner; part of the game interest is the excitement of being declared a winner. In the remote playing of BINGO, as hereinabove described, the event of drawing the numbers is preferably televised, either over a local television station or in a closed-circuit television system (e.g. to all the rooms in a hotel or a group of hotels). The remotely located players can view the T.V. picture, and observe their names being announced as winners; or computers may identify the winners and fax the information relating to specific winners.

The computer is preferably selected or sized so that computer operations involved in determining the winners are fast enough to keep pace with the process of drawing the numbered equally weighted especially made balls out of the hopper. In cases where there are large number of game players a plurality of computers may be connected to a single number punch-in keyboard, such that the various computers are in their computing modes at the same time.

Ordinarily a BINGO sessions will involve playing several separate BINGO games. The game sheet 10 filled out by the player can be reused for several games (by storage of the information in the computer memory). A player can fill out any number of sheets 10 applicable to any given BINGO session.

The BINGO card shown in FIG. 1 is particularly applicable for the remote playing of the game (wherein the game players are not physically present at the site where the BINGO numbers are being physically present at the site where the BINGO numbers are being drawn). FIG. 3 shows a BINGO card (or sheet) that is used where the player is physically present at the game site location.

The FIG. 3 BINGO sheet is similar to the FIG. 1 sheet insofar as the manner in which the player selects the numbers that he wishes to play; i.e. one numeral in each of the twenty four BINGO spaces is marked with a pen or pencil to indicate the selected number. However, there is a different way for transmitting the game sheet to the game operator (establishment).

At the game site a player can physically hand over the completed game sheet to a cashier, along with the associated payment. The cashier makes a copy of the game sheet and hands it back to the player; the game sheet will be inserted into a reader, similar to reader 23, for entry of the information into the computer. The game is played as previously described.

The game sheet of FIG. 3 can also be used for playing the game remotely, in those situations where readers 23 remote from the game site are available. For example, an attendant or clerk in a grocery store, gas station, etc. equipped with a reader device 23, could receive a game sheet for physical insertion into the reader device. In that situation the game sheet information could be transmitted telephonically from the remote site to the central game with computer. The attendant or clerk would in such case provide the game player with a copy of the game sheet stating game number, time and participation number for receipt purposes.

The method of the present invention is advantageous in that the BINGO game player has a choice in the numbers he or she wishes to play. Also, the game player can play the game from a remote site; he does not have to travel to the place where the numbers are drawn. Further, the game player can play without cash on hand, using a credit card, having the charge billed to his home telephone number, or applying the cost to his/her account number with the game operator.

In any given game some of the players may be in attendance at the game site, while other players may be off site, i.e. not physically present.

The BINGO cards shown in FIGS. 1 and 3 can be made compatible with each other so that both types of cards are usable with the same computer. Any given BINGO game can have some participants in physical attendance at the site, and some participants located elsewhere.

What is claimed is:

1. A method of participation in the playing of a game of chance prediction of a winning number combination, wherein said method comprises:

(a) each game player manually completing a game sheet, wherein each game sheet comprises multiple numbered spaces arranged in five vertical columns that collectively form five horizontal rows of numbered spaces; each said space having all of the numbers therein that the player can selectively mark to indicate the player's choice of a winning number for that space, within the game rules; each marked game sheet being machine-readable when the game sheet is completed; the game sheet completing step comprising each game player selectively marking only one of the numbers in each said space;

(b) each game player transmitting the respective marked game sheet to a game site operator who runs the game of chance;

(c) the game site operator passing each marked game sheet through an electronic reader that is associated with a computer having a memory, whereby the marked numbers on each respective game sheet are put into the computer memory;

(d) the game site operator transmitting back to each game player a copy of the player's marked game sheet so that each game player has visible proof of the marked numbers on the respective game sheet, and (e) the game site operator operating a number selection machine that selects a winning number combination on a random chance basis; and (f) the game site operator entering the winning number combination into the computer, whereby the computer compares the winning numbers with the numbers put into the computer memory in step (d).

2. The method of claim 1, wherein step (b) is performed by the game player inserting the respective marked game sheet into a facsimile phone machine that is electronically connected with a facsimile phone machine at the game site, whereby the game player is enabled to play the game from a location remote from the game site.

3. The method of claim 1, wherein step (d) is accomplished by the game site operator inserting a copy of the player's marked game sheet into a facsimile phone machine at the game site, such that the copy is electronically transmitted to a facsimile phone machine remote from the game site.

4. The method of claim 1, and further comprising the step of:

(g) passing the marked game sheet from the electronic reader through a rejection mechanism for detection of errors on the game sheet that would make the game player ineligible to become a winner.

5. The method of claim 4, and further comprising the step of (h) a human technician at the game site phoning game players the reasons for ineligibility discovered in step (g).

6. The method of claim 1, wherein step (a) includes the player writing his, or her, signature on the respective game sheet.

7. The method of claim 1, wherein each numbered space has fifteen numbers therein.

8. The method of claim 7, wherein the game being played in BINGO.

9. A method of participation in the playing of a game of chance prediction of a winning number combination, wherein said method comprises:

(a) each game player manually completing a game sheet, wherein each game sheet comprises multiple numbered spaces arranged in vertical columns that collectively form horizontal rows of numbered spaces; each said numbered space having all of the numbers therein that the game player can selectively mark to indicate the player's choice of a winning number for that space;

each marked game sheet being machine-readable when the game sheet is completed; the game sheet completing step comprising each game player selectively marking only one of the numbers in each said space;

(b) each game player transmitting the respective marked game sheet to a game site operator who runs the game of chance;

(c) the game site operator passing each marked game sheet through an electronic reader that is associated with a computer having a memory, whereby the marked numbers on each respective game sheet are put into the computer memory;

(d) the game site operator transmitting back to each game player a copy of the player's marked game sheet so that each game player has visible proof of the marked numbers on the respective game sheet;

(e) the game site operator operating a number selection machine that selects a winning number combination on a random chance basis; and (f) the game site operator entering the winning number combination into the computer, whereby the computer compares the winning numbers with the numbers put into the computer memory in step (d).

* * * * *